US005506471A

United States Patent [19]

Kosmatka et al.

[11] Patent Number: 5,506,471

[45] Date of Patent: Apr. 9, 1996

[54] LOW GLARE INFRARED LIGHT SOURCE

[75] Inventors: Walter J. Kosmatka, Highland Heights; Gustino J. Lanese, Chesterland, both of Ohio

[73] Assignee: General Electric Company, Schenectady, N.Y.

[21] Appl. No.: 254,836

[22] Filed: Jun. 6, 1994

[51] Int. Cl.[6] ..... H01K 1/32

[52] U.S. Cl. ..... 313/635; 313/113; 313/112; 313/580; 362/290

[58] Field of Search ..... 313/635, 578, 313/580, 112, 635, 578, 580, 112, 274, 283, 113; 362/296

[56] References Cited

U.S. PATENT DOCUMENTS

| | | | |
|---|---|---|---|
| 4,249,101 | 2/1981 | Walsh | 313/112 |
| 4,275,327 | 6/1981 | Walsh | 313/112 |
| 4,331,901 | 5/1982 | de Vrijet et al. | 313/112 |
| 4,535,269 | 8/1985 | Tschetter et al. | 313/580 |
| 4,580,199 | 4/1986 | Wurster et al. | 362/296 |
| 4,924,359 | 5/1990 | Lindae et al. | 362/296 |
| 5,045,748 | 9/1991 | Ahlgren et al. | 313/580 |
| 5,254,902 | 10/1993 | Griffin et al. | 313/274 |

*Primary Examiner*—Donald J. Yusko
*Assistant Examiner*—Michael Day
*Attorney, Agent, or Firm*—George E. Hawranko; Stanley C. Corwin

[57] ABSTRACT

Glare or stray light from a lamp is controlled by determining the location of a filament relative to a major axis of the ellipsoidal portion of a lamp envelope. Once the maximum deviation of the filament from the major axis has been determined, the lamp may be marked with indicia, or immediately secured to a base to assure the location of the filament in the final assembly of the headlamp. Any stray or glare light is then controlled or directed in a predetermined manner.

7 Claims, 4 Drawing Sheets

LOW GLARE INFRARED LIGHT SOURCE

BACKGROUND OF THE INVENTION

This invention pertains to incandescent lamps and more particularly to an incandescent lamp that includes an envelope having an ellipsoidal portion with a coating that reflects a selected portion or spectrum of emitted light toward a filament housed within the envelope. The invention finds particular applicability in the automotive industry for use in a headlamp, although the invention may find applicability in still other environments and applications.

A typical headlamp assembly includes a light source or lamp located at a focus of a reflector so that light emitted from the light source is directed through a lens of the headlamp assembly to achieve a predetermined beam pattern. An ideal lamp for use in the headlamp assembly is a halogen infrared light source in which a portion of the emitted radiation is reflected by a coating on the light source envelope toward the filament to achieve a goal of increased efficiency of the lamp. The reflection is achieved through use of an ellipsoidally shaped portion of the envelope having an external interference filter or coating preferably comprised of alternating layers of two or more materials having different refractive indexes. The filament is substantially aligned with the longitudinal axis of the envelope and the coating is intended to selectively transmit portions of the visible radiation emitted by the filament while reflecting other portions of the radiation.

For example, a multi-layer coating of tantala and silica material provided on a quartz envelope with the filament substantially coincident with the major axis of the ellipsoidal portion reflects infrared radiation toward the filament. The infrared energy returned to the filament further heats the filament to improve the overall efficacy of the lamp. To maximize the output of the light source, it is important to align the filament with the major axis of the ellipsoidal portion of the envelope. Ideally, a filament located directly on the center line of the ellipse would maximize the temperature of the filament in response to the reflected infrared radiation.

A second concern with headlamp assemblies is to eliminate glare from the projected beam pattern. One cause of glare is the off-center location of the filament relative to the major axis of the ellipsoidal portion of the envelope. A virtual image is formed on the opposite side of the axis as a result of radiation reflected by the envelope coating. This virtual image is at a location that results in glare and can adversely affect the desired beam pattern.

If the filament is substantially offset relative to the major axis, glare resulting from a virtual image becomes less of a problem. However, when the competing concern is to locate the filament substantially on axis, and the virtual image forms at a region offset but close to the major axis, glare becomes a particular problem. In reality, the filament is rarely located directly on a major axis and these competing concerns must be addressed in a manner that satisfactorily resolves both goals.

SUMMARY OF THE INVENTION

The present invention contemplates a new and improved lamp and method of forming the lamp that overcomes all of the above-referenced problems and others and provides for a simple, effective solution for controlling glare when the light source is mounted in the associated lamp housing.

According to the present invention, there is provided a light source having an envelope formed of a light transmissive material that includes an ellipsoidal portion having a major axis. A filament is received in the envelope and is substantially aligned with the major axis. A coating on the envelope reflects selected wavelengths of the light toward the filament to increase the efficiency of the lamp. Glare in the generated beam pattern is controlled by orienting the filament relative to a base in a predetermined manner so that the position of any resulting virtual image will be in a desired location.

According to another aspect of the invention, the filament is positioned below the generally horizontally disposed major axis of the envelope to assure that any glare associated therewith is directed downwardly and away from an oncoming driver's view.

According to another aspect of the invention, the envelope is marked with indicia to properly orient the filament relative to the base.

A preferred method of assembling the lamp includes determining the location of the filament relative to the major axis and orienting the filament to assure that any stray or glare light is directed in a predetermined manner.

A principal advantage of the invention is that the precise location of the filament relative to the ideal alignment with the major axis is determined as opposed to leaving the orientation of the filament to chance.

Another advantage of the invention is the ability to control glare from the light source.

Still other advantages and benefits of the invention will become apparent to those skilled in the art upon a reading and understanding of the following detailed description.

BRIEF DESCRIPTION OF THE DRAWINGS

The invention may take physical form in certain parts and arrangements of parts, preferred embodiments, and a method of forming same, of which will be described in detail in this specification and illustrated in the accompanying drawings which form a part hereof, and wherein.

DETAILED DESCRIPTION OF THE PREFERRED EMBODIMENT AND METHOD

Figure 1:
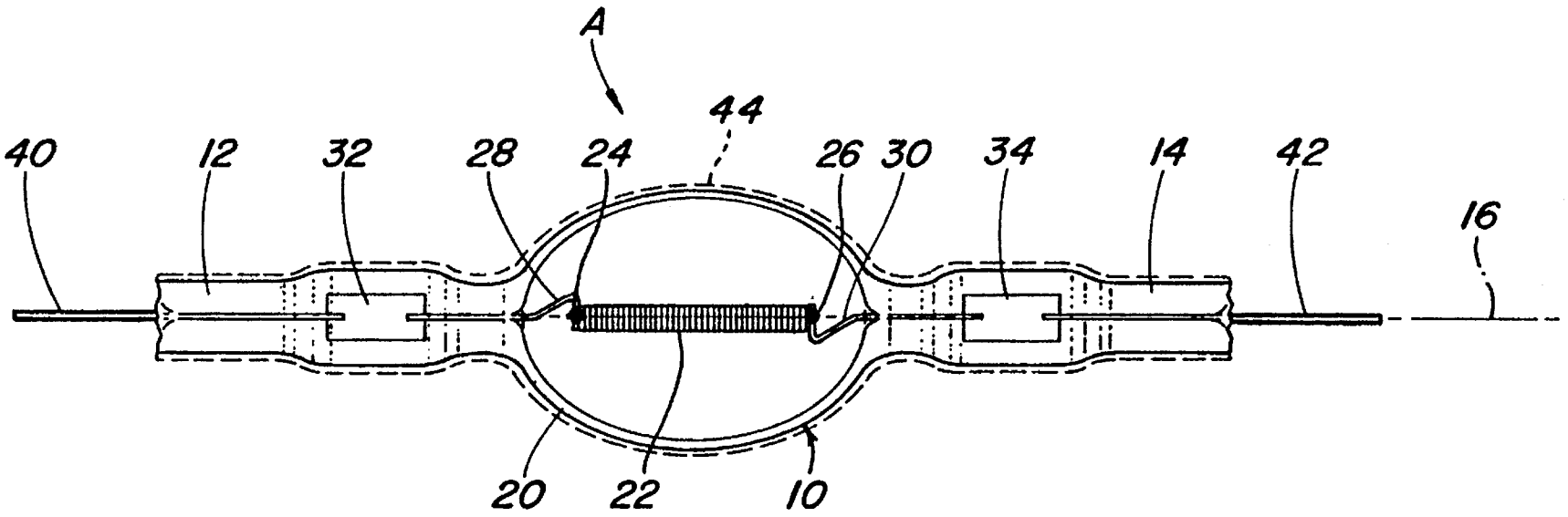
FIG. 1 shows a double-ended incandescent lamp having a central elliptical portion and a coating on the envelope that reflects infrared radiation toward the filament.

Referring now to the drawings wherein the showings are for purposes of illustrating the preferred embodiment and method of assembly of the invention only and not for purposes of limiting same, the FIGURES show an incandescent light source A finding particular use in the automotive industry where directional control of emitted light is an important consideration. Turning first to FIG. 1, the light source A includes a double-ended envelope 10 formed from a vitreous or light transmissive material. In a preferred arrangement the envelope is formed of a quartz material. Of course, other light transmissive materials can be used without departing from the scope and intent of the subject invention.

Opposite ends 12, 14 of the envelope are generally aligned along longitudinal axis 16. A central portion 20 of the envelope has a generally elliptical configuration. The major axis of the elliptical configuration is intended for alignment with the longitudinal axis 16 for reasons which will become more apparent below. Contained within the ellipsoidal portion is a filament 22, usually of tungsten. The filament is also preferably mounted for alignment with the longitudinal axis 16 of the envelope, and likewise, the major axis of the ellipsoidal portion.

Opposite ends 24, 26 of the filament are secured to first and second inner leads 28, 30, respectively. Outer axial ends of the inner leads are sealed within the respective ends 12, 14 of the envelope. The inner leads are preferably connected to a thin metal foil such as a molybdenum foil 32, 34. Also connected to the metal foils, and received in the opposite ends of the envelope, are first and second outer leads 40, 42. The outer leads are typically connected to support members or lead wires in a well known manner to provide a desired mounting orientation of the light source. Simultaneously, the support members are formed from a electrically conductive material such as metal wire to provide electrical current to the filament.

When energized, the filament emits radiation, a selected spectrum of the emitted radiation is reflected toward the filament by interference filter or coating 44 applied to the outer surface of the envelope. Preferably, the coating is comprised of multiple layers of refractory metal oxides having alternating high and low indexes of refraction. The coating reflects the infrared portion of the emitted radiation toward the filament to raise its temperature and improve the overall operating efficiency of the lamp.

Figure 2:
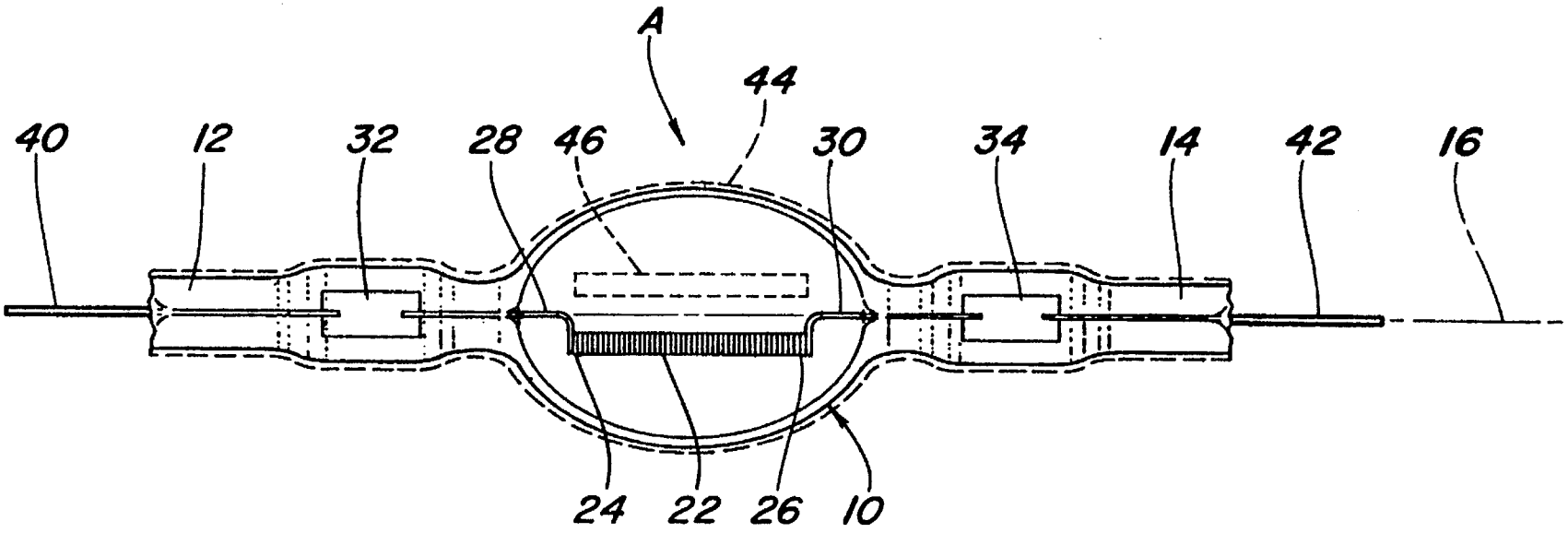
FIG. 2 shows a light source substantially similar to FIG. 1 but in which the filament is shown offset from the major axis of the elliptical portion.

As shown in FIG. 1, the filament 22 is ideally aligned and coincidental with the longitudinal axis 16 and, more importantly, aligned with and coincidental with the major axis of the ellipsoidal portion. This assures that the infrared radiation reflected by the coating will be directed toward the major axis and elevate the temperature of the filament. In reality, the filament will be slightly offset from the major axis. Ideal spatial orientation and location of the filament within the pressurized envelope is very difficult to achieve. Accordingly, and as shown in exaggerated form in FIG. 2, the filament is offset from the major axis. As a result, redirected, secondary light which does not impinge on the filament forms a "secondary" virtual image 46 of the real source. The location of the virtual source is on the opposite side of the centerline or longitudinal axis 16 from the location and orientation of the real source. For example, if the real source is above the lamp center line, the virtual source is below. Likewise, if the real source is below the lamp center line, the virtual source is above.

When used in a headlamp assembly, a reflector (not shown) receives light from the source and directs it through a lens to provide a predetermined beam pattern. Regulatory rules provide specifications that must be met with regard to the desired beam pattern so that light projected forwardly from the headlamp does not adversely interfere with an oncoming driver's vision. Thus, it is important to control projection of light above the lamp horizontal plane.

On one hand, it is important to keep the filament as close to the major axis of the ellipsoidal portion to maximize the output and efficiency of the light source. On the other hand, glare or stray light must be maintained below the lamp horizontal plane in order to meet federal regulations. It is important to determine where any misalignment between the filament and major axis is, and then control that non-ideal situation in a manner that does not adversely affect the output of the headlamp relative to regulatory rules. The orientation of the lamp, and particularly the filament, must be determined so as to achieve a desired mounted orientation of the lamp relative to a housing or base. Once the orientation is determined, the lamp is then fixed to its base.

It must be kept in mind that a deliberate offset of the filament relative to the major axis would defeat the purpose of maximizing the output or efficiency of the lamp. A deliberate offset would result in the virtual source being sufficiently spaced from the filament as to have little effect on the beam pattern. Instead, difficulty with glare or stray light is encountered where the filament and the virtual source are close together, i.e. slightly offset from the major axis.

Thus, the lamp or light source is generally manufactured in accordance with known technology. The first goal is to meet the ideal situation where the filament is perfectly aligned with the major axis of the ellipsoidal portion. If this is achieved, glare is not a problem since an offset, virtual source is not formed.

Thereafter, and according to the teachings of this invention, the location of the filament relative to the major axis must be determined. A preferred method for determining the location of the filament is to back light the lamp prior to securing the lamp in a base or housing. The back lighting procedure advantageously provides an outline of the filament and envelope. By magnifying the back-lit image of the lamp, one can determine where the centers or foci of the ellipsoidal portion are, rotate the lamp, and choose the greatest dimension of deviation between the filament and the major axis.

Figure 5:
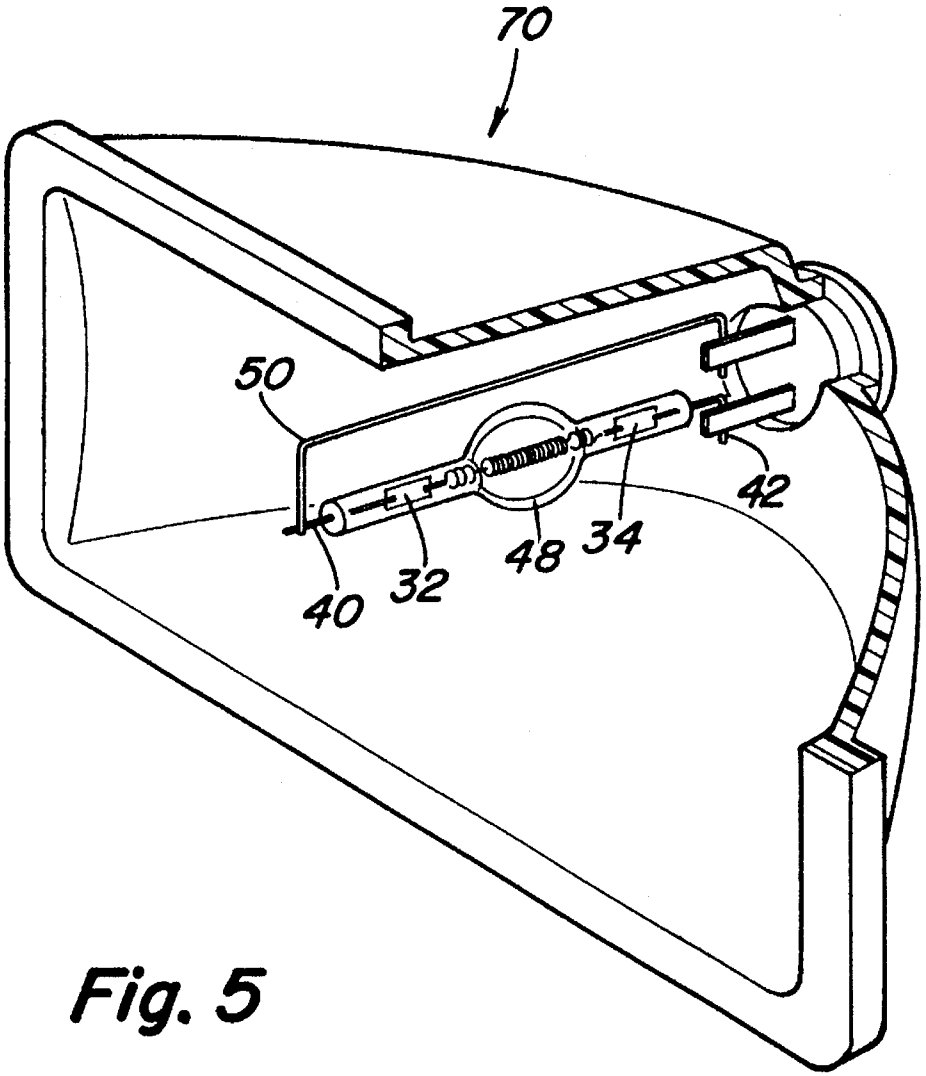
FIG. 5 is a perspective view of an incandescent light source in a headlamp assembly.

The envelope is then appropriately marked as represented by numeral 48 (FIG. 5) to provide an indication of the greatest dimension of deviation. In further assembly of the lamp to a base, the indicia can be used to locate or orient the lamp, and more importantly the filament, in the desired manner.

Figure 3:
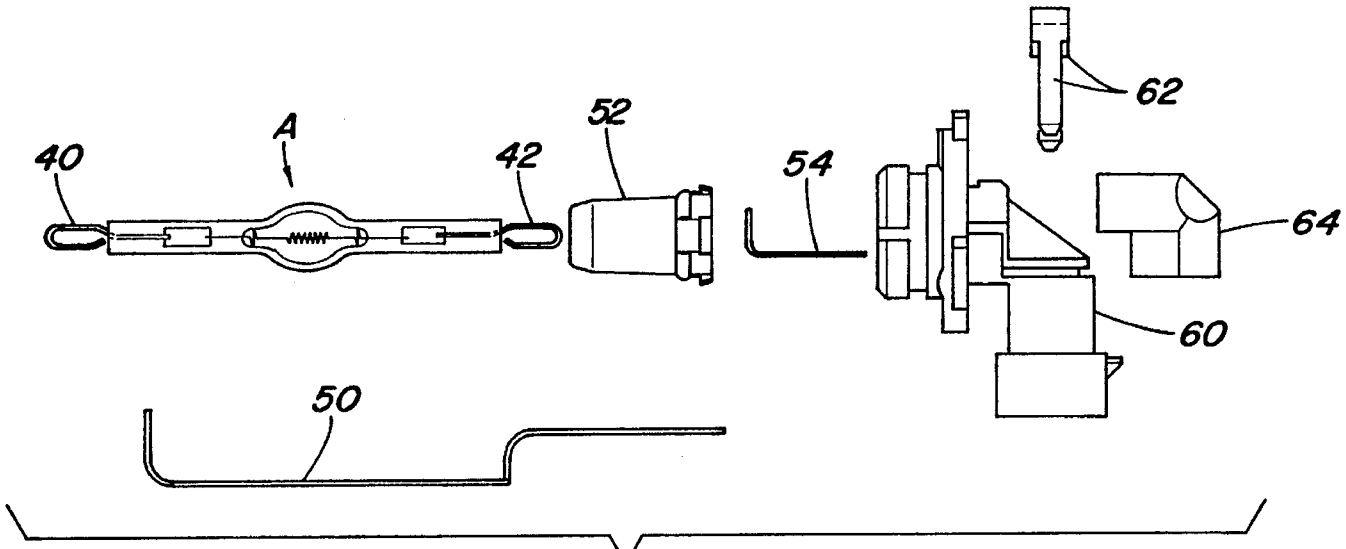
FIG. 3 is an exploded view illustrating the various components of a preferred lamp assembly.
Figure 4:
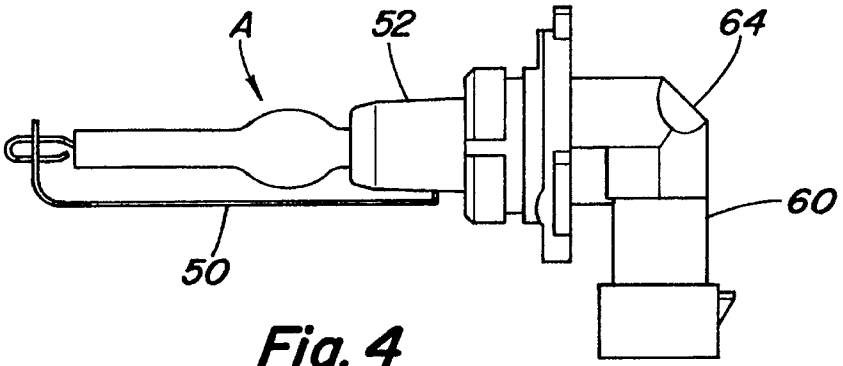
FIG. 4 is an elevational view of the lamp assembly after the components have been secured together.

Next, the lamp is secured to the base or some other fixed component so that the resultant position of the filament is known and glare is controlled, while trying to achieve maximum output from the lamp. This fixing or mounting step is illustrated in FIGS. 3 and 4. The light source A has a first end 40 secured to one end of a first support member or ground wire 50. The support member provides both electrical connection and mechanical support to the outer lead 40 of the lamp. The second end 42 of the light source is received in a second support member or gimbal 52 in which electrical connection is established between the second outer lead and an extension lead wire 54.

As best shown in FIG. 4, the support 52 is secured to base 60 so that a desired orientation and location of the lamp relative to the base can be achieved. Electrical terminals 62 are received in the base and a cap 64 cooperates with the base to seal the mounting assembly. In this manner, the lamp is fixed in location relative to the base, and an electrical connection can be easily established through the base with the terminals which, in turn, provide current to the lamp through lead wire 54 and support member 50.

The reflector portion 70 of the headlamp is fixed in the automotive vehicle. These types of replaceable lamps are received through an opening in the reflector and rotated or otherwise locked in place so that the lamp is located at the focus of the reflector. Further details of the general structure and operation of headlamps form no part of the subject invention so that further discussion herein is deemed unnecessary.

In accordance with this invention, it is desired that the filament be located below the horizontal center line of the headlamp axis. The virtual source, therefore, is located above the horizontal center line of the headlamp, and any off-focus or stray light emitted from the virtual source will be directed below the lamp horizontal plane. In this manner, the resultant glare is controlled while maximizing light output from the lamp.

It will be recognized that still other ways of determining the location of the filament relative to the major axis of the ellipsoidal portion can be used. Once the deviation between the axis of the filament and the major axis of the ellipse is determined, the lamp is fixed relative to the base. This assures that glare can be controlled in a manner as described above.

Moreover, it will be recognized that it may not be necessary to provide indicia on the lamp after the location and orientation of the filament have been determined. During assembly of the lamp, once the filament location has been determined, the assembly machinery can orient or hold the lamp in position until the lamp has been secured to a base or other component of the assembly that fixes the final orientation of the lamp in the headlamp assembly.

The invention has been described with reference to the preferred embodiment and method of assembly. Still modifications and alterations will occur to others upon a reading and understanding of this specification. It is intended to include all such modifications and alterations insofar as they come within the scope of the appended claims or the equivalents thereof.

What we claim as new and desire to secure by Letters Patent of the United States is:

1. A light source comprising:

an envelope formed from a light transmissive material and including an ellipsoidal portion having a major axis;

a filament received in the envelope and substantially aligned with, but slightly offset from, the major axis of the ellipsoidal portion of the envelope;

first and second lead wires electrically connected to opposite ends of the filament so that the filament can be energized and emit radiation;

a coating disposed on at least a portion of the envelope for reflecting selected wavelengths of emitted light toward the filament;

a reflector disposed adjacent the envelope for receiving light emitted by the filament and directing the light in a predetermined direction, the slightly offset filament generating glare associated with a secondary, virtual image resulting from an inability to precisely align the filament with the major axis; and a base to which the filament and envelope are mounted relative to the reflector, the filament being oriented in a predetermined manner relative to the base in order to control glare from the virtual image.

2. The light source as defined in claim 1 further comprising indicia on the envelope for orienting the filament relative to the base.

3. The light source as defined in claim 1 wherein the major axis of the envelope ellipsoidal portion is disposed generally horizontally.

4. The light source as defined in claim 3 wherein the filament is positioned below the generally horizontally disposed major axis of the envelope ellipsoidal portion.

5. A headlamp comprising:

a filament disposed in an envelope having an ellipsoidal portion, the filament being substantially aligned with a major axis of the ellipsoidal portion; and a reflector disposed adjacent the filament to receive light emitted therefrom when energized and to direct the light in a desired direction, the filament being slightly offset from the major axis in a direction below a horizontal plane extending through the major axis to control glare associated with a secondary, virtual image resulting from the slight offset of the filament.

6. The headlamp as defined in claim 5 wherein the envelope includes indicia thereon to facilitate disposition of the offset filament below the horizontal plane.

7. The headlamp as defined in claim 5 further comprising a coating on at least a portion of the envelope for reflecting selected wavelengths of emitted light toward the filament.

* * * * *